US011222603B2

(12) United States Patent
Cho et al.

(10) Patent No.: US 11,222,603 B2
(45) Date of Patent: Jan. 11, 2022

(54) DISPLAY DEVICE AND DRIVING METHOD THEREOF

(71) Applicant: Samsung Display Co., Ltd., Yongin-si (KR)

(72) Inventors: Seong Heon Cho, Yongin-si (KR); Hae Kwan Seo, Yongin-si (KR); Seung Jae Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/817,403

(22) Filed: Mar. 12, 2020

(65) Prior Publication Data

US 2021/0027719 A1 Jan. 28, 2021

(30) Foreign Application Priority Data

Jul. 26, 2019 (KR) ..... 10-2019-0091011

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2320/0223* (2013.01); *G09G 2330/00* (2013.01)

(58) Field of Classification Search
CPC ... G09G 2300/0842; G09G 2300/0819; G09G 2300/0809; G09G 2300/0861; G09G 2300/0866; G09G 2300/0426; G09G 3/3233; G09G 3/3241; G09G 3/325; G09G 3/3648; G09G 2320/0223; G09G 2320/045; G09G 2320/043; G09G 2320/0204; G09G 2320/0252; G09G 2310/0262; G09G 2310/0275
See application file for complete search history.

(56) References Cited

U.S. PATENT DOCUMENTS 9,047,813 B2 6/2015 Minami et al.
2002/0105279 A1* 8/2002 Kimura ..... G09G 3/3275 315/169.3
2006/0061526 A1* 3/2006 Shirasaki ..... G09G 3/3233 345/77
2006/0066642 A1* 3/2006 Ookawara ..... G09G 3/20 345/690
2007/0024541 A1* 2/2007 Ryu ..... G09G 3/3283 345/76
2008/0012812 A1* 1/2008 Kawata ..... G09G 3/3648 345/90

(Continued)

FOREIGN PATENT DOCUMENTS

JP 5891492 B2 3/2016
KR 10-2018-0135434 A 12/2018

*Primary Examiner* — Dong Hui Liang
(74) *Attorney, Agent, or Firm* — Lewis Roca Rothgerber Christie LLP

(57) ABSTRACT

A display device and a driving method thereof are provided. The display device includes a display including a pixel including a double gate transistor and a light emitting diode, a power supply for supplying power to the display, a current sensor for sensing a current flowing in the display or in the light emitting diode, and a gate voltage controller for providing a bias voltage signal to one gate electrode of the double gate transistor.

16 Claims, 14 Drawing Sheets

(56) References Cited

U.S. PATENT DOCUMENTS

| | | | | |
|---|---|---|---|---|
| 2008/0074358 | A1* | 3/2008 | Ogawa | G09G 3/3233 345/76 |
| 2008/0180157 | A1* | 7/2008 | Choi | G06F 1/26 327/384 |
| 2015/0243218 | A1* | 8/2015 | Tseng | G09G 3/3258 345/212 |
| 2016/0125796 | A1* | 5/2016 | Ohara | G09G 3/3233 345/211 |
| 2017/0047027 | A1* | 2/2017 | Nambi | G09G 3/3618 |
| 2017/0243532 | A1* | 8/2017 | Huang | H02M 3/07 |
| 2018/0047333 | A1* | 2/2018 | Nie | G09G 3/3258 |
| 2019/0019458 | A1* | 1/2019 | Teraguchi | H01L 27/3248 |
| 2019/0079330 | A1* | 3/2019 | Yamamoto | H01L 27/1225 |
| 2019/0079336 | A1 | 3/2019 | Nam et al. | |

* cited by examiner

<2.2 Gamma Curve>

DISPLAY DEVICE AND DRIVING METHOD THEREOF

CROSS-REFERENCE TO RELATED APPLICATION

This application claims priority to, and the benefit of, Korean Patent Application No. 10-2019-0091011 filed in the Korean Intellectual Property Office on Jul. 26, 2019, the entire contents of which are incorporated herein by reference.

BACKGROUND

1. Field

The present disclosure relates to a display device, and to a driving method of the display device.

2. Description of the Related Art

Recently, a field for displays that visually express an image corresponding to an electrical information signal has been developed rapidly. As a result, various display devices with excellent attributes, such as thinning, lightening, and low power consumption, have been developed. Some examples of such display devices include a liquid crystal display, a field emission display, and an organic light emitting diode display.

Each of pixels constituting the organic light emitting diode display includes an organic light emitting diode composed of an organic emission layer between an anode and a cathode, and a pixel circuit that independently drives the organic light emitting diode. The pixel circuit includes a switching transistor, a driving transistor, and a capacitor of thin film type.

In the organic light emitting diode display, a difference in characteristics, such as differences corresponding to a threshold voltage and/or a mobility of a driving transistor, may occur for each pixel due to process deviation. As a result, a voltage drop of a high potential voltage may occur, and thus the amount of the current driving the organic light emitting diode changes, thereby generating a luminance deviation between the pixels.

In general, unintended spots or patterns may occur on a display screen due to differences in characteristics of respective initial driving transistors. A characteristic difference due to a degradation of the driving transistor that is generated while driving the organic light emitting diode may reduce a lifespan of the organic light emitting diode, or may generate an afterimage on the display screen. Accordingly, attempts have been made to improve an image quality by reducing a luminance deviation between pixels by providing a compensation circuit for compensating for the characteristic deviation of the driving transistor, and for compensating for a voltage drop of a high potential voltage.

Therefore, a power consumption of the organic light emitting diode display may be reduced by variously changing a driving method of the organic light emitting diode display. A low-speed driving method that makes a frequency that is for driving an organic light emitting diode display, and that is smaller than a basic driving frequency, has been studied as one of the driving methods that may reduce the power consumption.

Meanwhile, in the low-speed driving method using a low frequency, a voltage level of a gate electrode charged with a data voltage of the driving transistor changes with time, so that the luminance change may be easily viewed by the user.

SUMMARY

Embodiments of the present disclosure provides a display device capable of reducing or minimizing a visibility of a luminance change to a user even when driven at a low frequency.

Aspects of the present disclosure are not limited to the above, and other aspects that are not mentioned herein may be clearly understood to a person of ordinary skill in the art using the following description.

A display device according to some embodiments of the present disclosure includes a display including a pixel including a double gate transistor and a light emitting diode, a power supply for supplying power to the display, a current sensor for sensing a current flowing in the display or in the light emitting diode, and a gate voltage controller for providing a bias voltage signal to one gate electrode of the double gate transistor.

The gate voltage controller may be configured to provide the bias voltage signal when the current sensor senses a current that changes by more than a ratio with respect to a target value.

The ratio may be 2%.

The target value may be the current flowing in the display or in the light emitting diode when a data voltage is applied to the pixel.

The display device may be configured to be driven at a frequency of about 1 Hz to about 30 Hz.

The gate voltage controller may be configured to provide the bias voltage signal at least once in one second.

The gate voltage controller may be configured to increase or decrease the bias voltage signal stepwise or linearly in the one second.

The gate voltage controller may be configured to provide the bias voltage signal having a positive voltage level when a current changes in a positive direction with respect to the target value, and may be configured to provide the bias voltage signal having a negative voltage level when a current changes in a negative direction relative to the target value.

The double gate transistor may include a bottom gate electrode, a semiconductor layer on the bottom gate electrode, a top gate electrode on the semiconductor layer, and a source electrode and a drain electrode on the top gate electrode.

The source electrode or the drain electrode of the double gate transistor may be connected to an anode of the light emitting diode.

The bottom gate electrode may be connected to a gate control line for receiving the bias voltage signal from the gate voltage controller.

The bottom gate electrode may have a greater area than the semiconductor layer.

The double gate transistor may be connected between a high power line and a low power line.

The double gate transistor may include a P-type transistor.

The P-type transistor may include a low temperature polysilicon (LTPS) semiconductor.

The gate voltage controller may include a power management integrated circuit (PMIC).

A driving method of a display device including a pixel including at least one double gate transistor and a light emitting diode that is electrically connected to a source or drain electrode of the double gate transistor, according to some embodiments of the present disclosure, includes applying a bias voltage signal to one gate electrode of the double gate transistor when a current flowing in the light emitting diode changes by a given ratio after applying a data voltage to the pixel.

Particularities and examples of embodiments are included in the detailed description and drawings.

According to embodiments of the present disclosure, the display device, which is driven at a variable frequency, can reduce or minimize a visibility of a luminance change to a user even when driven at a low frequency.

Aspects of embodiments of the present disclosure are not limited by what is illustrated in the above, and various other aspects are included in the present specification.

BRIEF DESCRIPTION OF THE DRAWINGS

Above and other aspects of embodiments of the present disclosure will become more apparent by describing in further detail embodiments thereof with reference to the accompanying drawings, in which.

DETAILED DESCRIPTION

Figure 1:
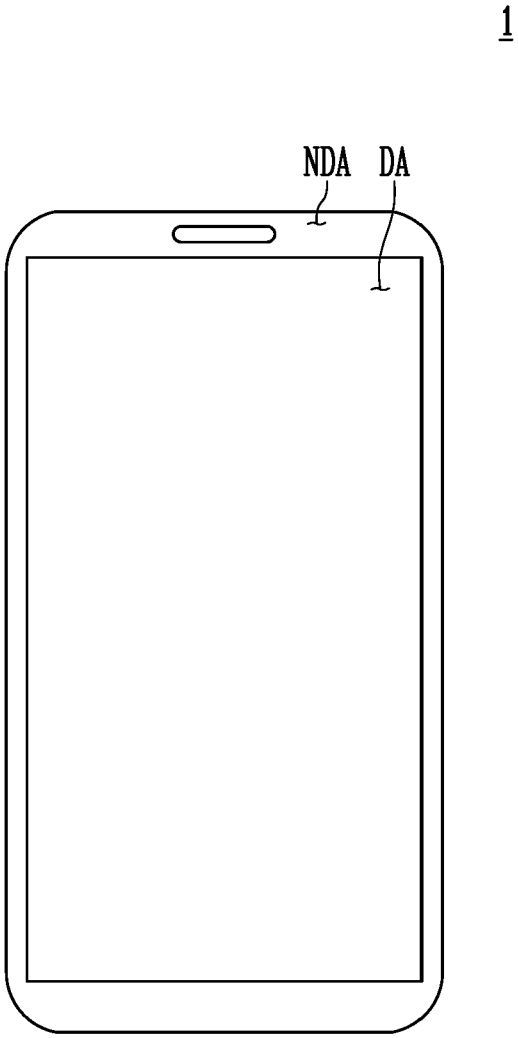
FIG. 1 is a top plan view schematically showing a display device according to some embodiments of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described.

Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Further, in this specification, the phrase "on a plane," or "plan view," means viewing a target portion from the top, and the phrase "on a cross-section" means viewing a cross-section formed by vertically cutting a target portion from the side.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing.

For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a top plan view schematically showing a display device according to some embodiments of the present disclosure.

Hereinafter, an organic light emitting diode display as an example of a display device 1 will be described. However, the present disclosure is not limited thereto, and other embodiments may be applied to other display devices, such as a liquid crystal display LCD, a field emission display, and/or an electrophoretic device, assuming the spirit of the present disclosure is not changed as a result.

Referring to FIG. 1, the display device 1 according to some embodiments of the present disclosure may include a display area DA and a non-display area NDA.

The display area DA is defined as an area that displays an image. In addition, the display area DA may be used as a detection member for detecting an external environment. That is, the display area DA may be used as an area for displaying an image and/or for recognizing a fingerprint of a user. The display area DA may have a flat shape. However, the present disclosure is not limited thereto, and one or more areas of the display area DA may be bent.

The non-display area NDA is defined as an area that is located outside the display area DA but does not display an image. In some embodiments, a speaker module, a camera module, and/or a sensor module may be located in the non-display area NDA. The sensor module may include at least one of an illumination sensor, a proximity sensor, an infrared sensor, and/or an ultrasonic wave sensor.

The display device 1 may be driven at a variable frequency. For example, when displaying a moving image, the display device 1 may be driven at a relatively high frequency of 60 Hz to 250 Hz, and when displaying a still image, the display device 1 may be driven at a low frequency of 1 Hz to 30 Hz. As a result, a power consumption of the display device 1 may be reduced.

Figure 2:
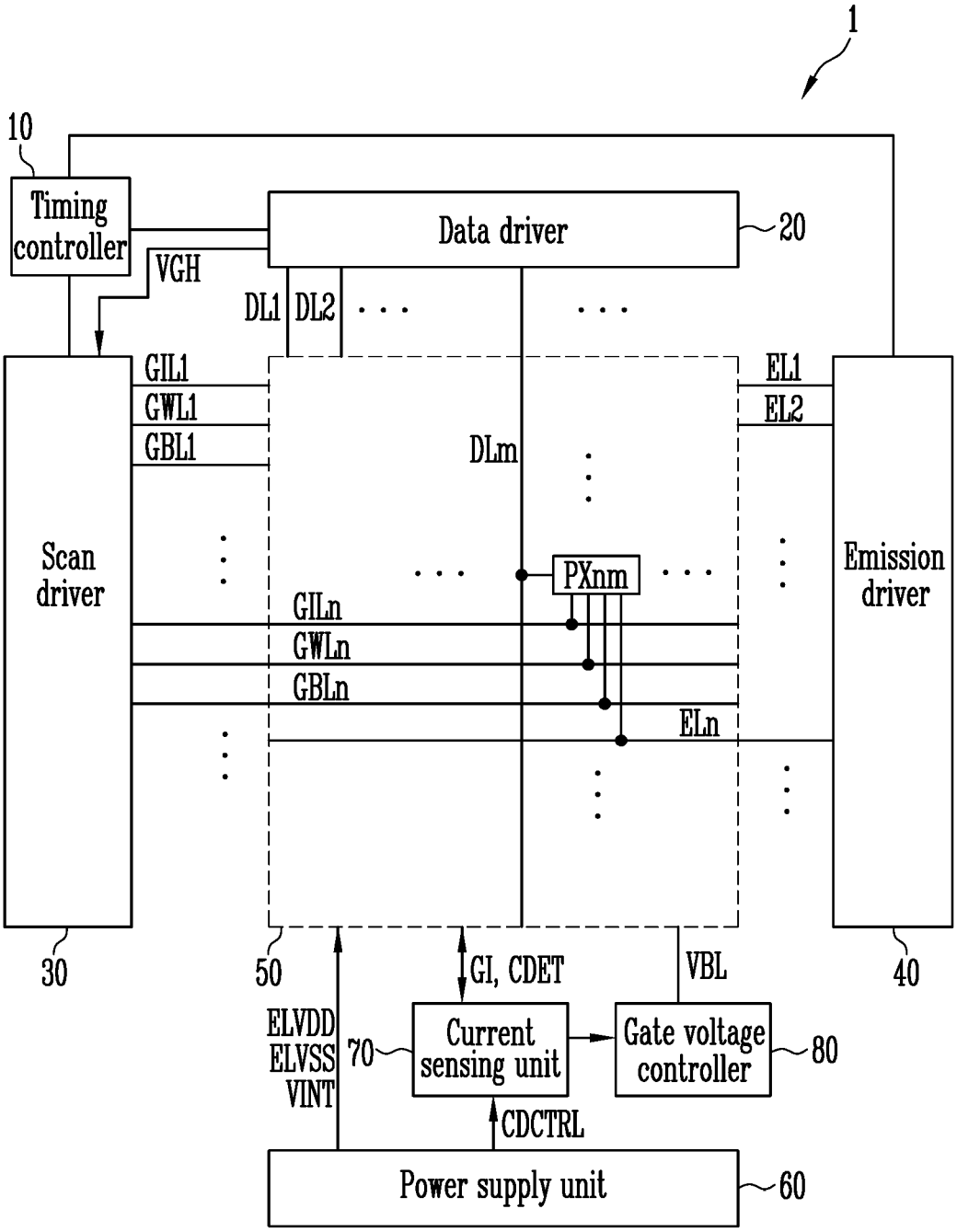
FIG. 2 is a block diagram schematically showing a display device according to some embodiments of the present disclosure.
Figure 3:
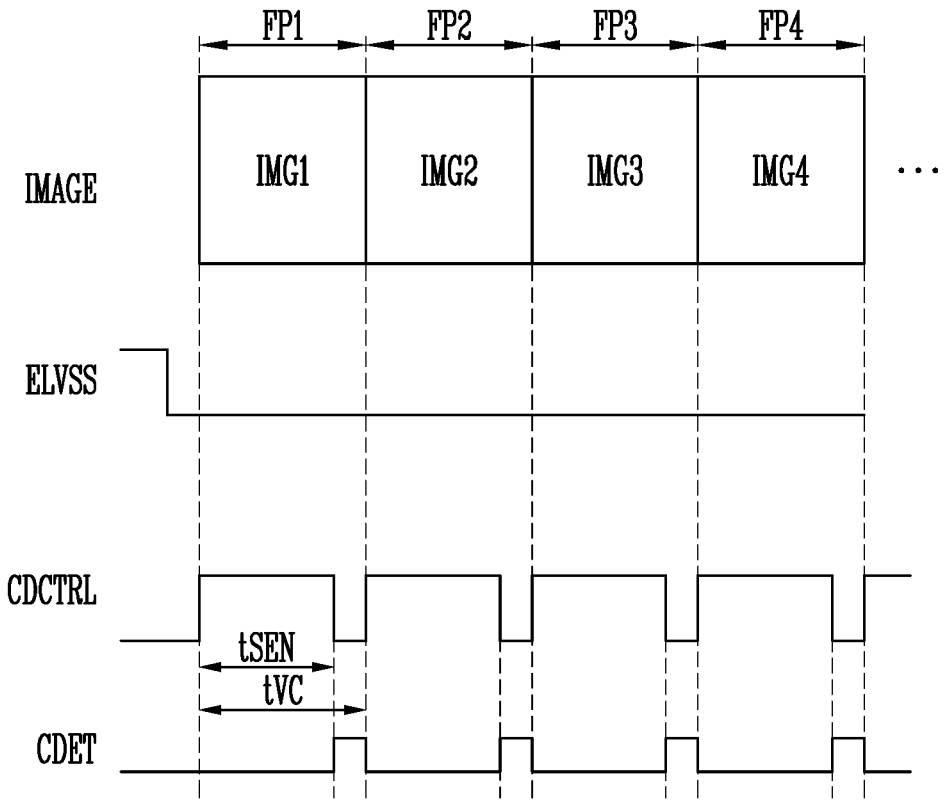
FIG. 3 is a timing diagram showing an example of an operation of a display device according to some embodiments of the present disclosure.

FIG. 2 is a block diagram schematically showing a display device according to some embodiments of the present disclosure. FIG. 3 is a timing diagram showing an example of an operation of a display device according to some embodiments of the present disclosure.

Referring to FIGS. 2 and 3, the display device 1 according to some embodiments of the present disclosure may include a timing controller 10, a data driver 20, a scan driver 30, an emission driver 40, a display/display unit 50, a power supply/power supply unit 60, a current sensor/current sensing unit 70, and a gate voltage controller 80.

The timing controller 10 may receive an external input signal for an image frame from an external processor to generate signals for display device 1. For example, the timing controller 10 may provide grayscale values and control signals to the data driver 20. In addition, the timing controller 10 may provide a clock signal, a scan start signal, etc. to the scan driver 30. In addition, the timing controller 10 may provide a clock signal, a light-emitting-stop signal, etc. to the emission driver 40.

The data driver 20 may generate data voltages to be provided to data lines DL1, DL2, and DLm using grayscale values and control signals received from the timing controller 10. For example, the data driver 20 may sample grayscale values using a clock signal, and may apply data voltages corresponding to the grayscale values to the data lines DL1, DL2, and DLm in units of pixel rows (e.g., to pixels connected to the same scan line).

The scan driver 30 may receive a clock signal, a scan start signal, etc. from the timing controller 10 to generate scan signals to be provided to scan lines GIL1, GWL1, GBL1, GILn, GWLn, and GBLn. As used herein, "n" may be a natural number.

In some embodiments, the scan driver 30 may include a plurality of sub-scan drivers. For example, a first sub-scan driver may provide scan signals for first scan lines GIL1 and GILn, a second sub-scan driver may provide scan signals for second scan lines GWL1 and GWLn, and a third sub-scan driver may provide scan signals for third scan lines GBL1 and GBLn. Each of the sub-scan drivers may include a plurality of scan stages connected with a form of a shift register. For example, scan signals may be generated by sequentially transferring pulses of turn-on levels of a scan start signal, which are supplied to a scan start line, to the next scan stage.

The emission driver 40 may receive a clock signal, a light-emitting-stop signal, etc. from the timing controller 10 to generate light-emitting signals to be provided to the light-emitting lines/light-emission control lines EL1, EL2, and ELn. For example, the emission driver 40 may sequentially provide light-emitting signals having pulses of turn-off levels to the light-emitting lines EL1, EL2, and ELn. For example, the emission driver 40 may be configured in a form of a shift register, and may generate the light-emitting signals sequentially by transferring pulses of turn-off levels of the light-emitting-stop signal to the next light-emitting stage according to a control of the clock signal.

The display 50 includes pixels PXnm. For example, the pixel PXnm may be connected to a corresponding data line DLm, to corresponding scan lines GILn, GWLn, and GBLn, and to a corresponding light-emitting line ELn.

A plurality of pixels PXnm may define a light-emitting area for emitting a plurality of colors. For example, a plurality of pixels PXnm may define a light-emitting area that emits lights of red, green, and blue. The pixel PXnm includes a plurality of transistors and a capacitor. At least some of a plurality of transistors in the pixel PXnm may be a double gate transistor having two gate electrodes.

The display 50 may define the display area DA (see FIG. 1) including a light-emitting area that emits a plurality of colors defined by the pixels PXnm.

The power supply 60 may provide a power supply voltage to an output terminal by receiving an external input voltage, and by converting the external input voltage. For example, the power supply 60 generates a high power supply voltage ELVDD and a low power supply voltage ELVSS based on the external input voltage. In the present disclosure, a high power supply and a low power supply may have a respective voltage level relative to each other. The power supply 60 may provide an initialization power supply VINT for initializing a gate electrode of the driving transistor and/or initializing an anode of the light emitting diode for each pixel PXnm.

The power supply 60 may receive an external input voltage from a battery or the like, and may boost the external input voltage to generate a power supply voltage that is higher than the external input voltage. For example, the power supply 60 may be configured as a power management integrated chip (PMIC). For example, the power supply 60 may be configured as an external DC/DC IC.

The power supply 60 may generate a current detection control signal CDCTRL such that a voltage control period tVC is changed depending on whether the image is properly operated through the display 50, and may provide the current detection control signal CDCTRL to the current sensor 70. In some embodiments, the display device 1 may include a separate voltage controller for generating a current detection control signal CDCTRL, and for providing the current detection control signal CDCTRL to the current sensor 70.

The current sensor 70 may sense a current supplied to the display 50. The current GI may be a driving current measured for each pixel PXnm, or a global current measured in a unit of a display 50 (e.g., in an entire panel unit).

The current sensor 70 may sense the current GI supplied to the display 50 in response to the current detection control signal CDCTRL representing the voltage control period tVC to generate a current detection signal CDET representing an average value the current GI value for each voltage control period tVC.

For example, the display device 1 may display one image through the display 50 during one frame period. As shown in FIG. 3, the display 50 may display a first image IMG1 during a first frame section FP1, a second image IMG2 during a second frame section FP2, a third image IMG3 during a third frame section FP3, and a fourth image IMG4 during a fourth frame section FP4.

In an example where the current sensor 70 measures the current GI, while display device 1 displays a plurality of images IMG1 to IMG4, the low power supply voltage ELVSS may maintain an active state at a negative voltage level. The voltage control period tVC in a two-dimensional mode may correspond to one frame period, and the current detection signal CDET may indicate an average value of the current GI for each frame period. In FIG. 3, the current detection signal CDET is shown in the form of including a pulse for each voltage control period tVC for convenience of description, but the current detection signal CDET may be a signal of a plurality of bits representing a digital value corresponding to an average value of the current GI for each voltage control period tVC.

The voltage control period tVC may include a sensing section tSEN for sensing the current GI, and the sensing section tSEN may correspond to a section in which the current detection control signal CDCTRL is activated at a logic high level. The current sensor 70 of FIG. 1 may calculate an average value by integrating the current GI during the sensing section tSEN. For example, when displaying an image at a reference frame rate of 120 fps (frames per second) (120 Hz), the voltage control period tVC, that is, one frame period, may correspond to about 8.33 ms, and the sensing section tSEN may be set to about 8.22 ms. In addition, when displaying images in accordance with some embodiments, because the same image is continuously displayed during one frame period, the current GI may be measured relatively accurately even when the sensing section tSEN is set to a portion of one frame period.

The gate voltage controller 80 may provide a bias voltage signal to one gate electrode of a double gate transistor in the pixel based on the current measured by the current sensor 70. For example, when a measured current that is measured by the current sensor 70 changes to a given degree (e.g., changes by more than a predetermined ratio) with respect to the target current, the gate voltage controller 80 may provide a bias voltage signal for compensating the measured current to be the target current. The gate voltage controller 80 may be connected to pixels PXnm of the display 50 through a gate voltage control line VBL.

The gate voltage controller 80 may be a module for managing a voltage signal supplied to the display 50 or to the pixel PXnm. For example, the gate voltage controller 80 may be configured as at least portion of a power management integrated circuit (PMIC).

Figure 4:
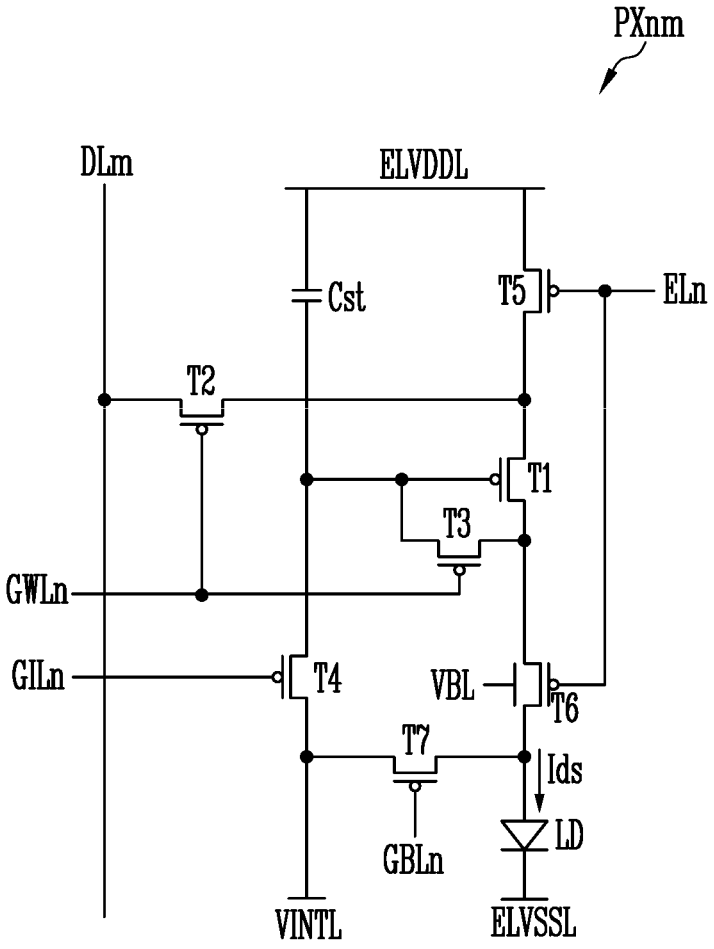
FIG. 4 is an equivalent circuit of one pixel in a display device shown in FIG. 2.

FIG. 4 is an equivalent circuit of one pixel in a display device shown in FIG. 2.

Referring to FIG. 4, the pixel PXnm according to some embodiments of the present disclosure includes transistors T1, T2, T3, T4, T5, T6, and T7, storage capacitor Cst, and a light emitting diode LD.

A first electrode of the first transistor T1 may be connected to a first electrode of the second transistor T2, a second electrode of the first transistor T1 may be connected to a first electrode of the third transistor T3, and a gate electrode of the first transistor T1 may be connected to a second electrode of the third transistor T3. The first transistor T1 may also be referred to as a driving transistor.

The first electrode of the second transistor T2 may be connected to the first electrode of the first transistor T1, a second electrode of the second transistor T2 may be connected to a data line DLm, and a gate electrode of the second transistor T2 may be connected to a first scan line GWLn. The second transistor T2 may be referred to as a scan transistor.

The first electrode of the third transistor T3 may be connected to the second electrode of the first transistor T1, the second electrode of the third transistor T3 may be connected to the gate electrode of the first transistor T1, and a gate electrode of the third transistor T3 may be connected to the first scan line GWLn. The third transistor T3 may be referred to as a diode-connection transistor.

A first electrode of the fourth transistor T4 may be connected to a second electrode of the storage capacitor Cst, a second electrode of the fourth transistor T4 may be connected to an initialization line VINTL, and a gate electrode of the fourth transistor T4 may be connected to a second scan line GILn. The fourth transistor T4 may be referred to as a gate initialization transistor.

A first electrode of the fifth transistor T5 may be connected to a high power line ELVDDL, a second electrode of the fifth transistor T5 may be connected to the first electrode of the first transistor T1, and a gate electrode of the fifth transistor T5 may be connected to a light-emitting line ELn. The fifth transistor T5 may be referred to as a first light-emitting transistor.

In some embodiments, the sixth transistor T6 may be a double gate transistor. A first electrode of the sixth transistor T6 may be connected to the second electrode of the first transistor T1, a second electrode of the sixth transistor T6 may be connected to an anode of the light emitting diode LD, a first gate electrode of the sixth transistor T6 may be connected to the light-emitting line ELn, and a second gate electrode of the sixth transistor T6 may be connected to the gate voltage control line VBL. The sixth transistor T6 may be referred to as a second light-emitting transistor.

A first electrode of the seventh transistor T7 may be connected to the anode of the light emitting diode LD, a second electrode of the seventh transistor T7 may be connected to the initialization line VINTL, and the gate electrode of the seventh transistor T7 may be connected to the scan line GBLn. The seventh transistor T7 may be referred as an anode initialization transistor.

The storage capacitor Cst may have a first electrode connected to the high power line ELVDDL, and may have the second electrode connected to the gate electrode of the first transistor T1.

The light emitting diode LD may have the anode connected to the second electrode of the sixth transistor T6, and may have a cathode connected to a low power line ELVSSL. A voltage applied to the low power line ELVSSL may be set lower than a voltage applied to the high power line ELVDDL. The light emitting diode LD may be an organic light emitting diode, an inorganic light emitting diode, a quantum dot light emitting diode, or the like.

The light emitting diode LD may emit light at an amount determined by a current level of a driving current Ids that is supplied from the high power line ELVDDL. The current level of the driving current Ids may be directly influenced by the transistors that are connected between the high power line ELVDDL and the low power line ELVSSL. For example, the transistors connected between the high power line ELVDDL and the low power line ELVSSL may correspond to first transistor T1, fifth transistor T5, and sixth transistor T6.

In some embodiments, the transistors T1 to T7 may be P-type (PMOS) transistors. Channels of the transistors T1-T7 may be formed of polysilicon. A polysilicon transistor may be a low temperature polysilicon (LTPS) transistor. The polysilicon transistor has a relatively high electron mobility and a relatively fast driving characteristic.

In some embodiments, the transistors T1 to T7 may be N-type (NMOS) transistors. In this case, the channels of the transistors T1 to T7 may be formed of an oxide semiconductor. An oxide semiconductor transistor may be processed at relatively low temperatures and may have a lower electron mobility than polysilicon. Therefore, an amount of a leakage current generated in a turn-off state of the oxide semiconductor transistors is generally smaller than that of the polysilicon transistors.

In some embodiments, some transistors (e.g., T1, T2, T5, T6, and T7) may be P-type transistors, and other transistors (e.g., T3 and T4) may be N-type transistors.

Next, a stacked structure of the display device 1 will be described with reference to FIG. 5.

Figure 5:
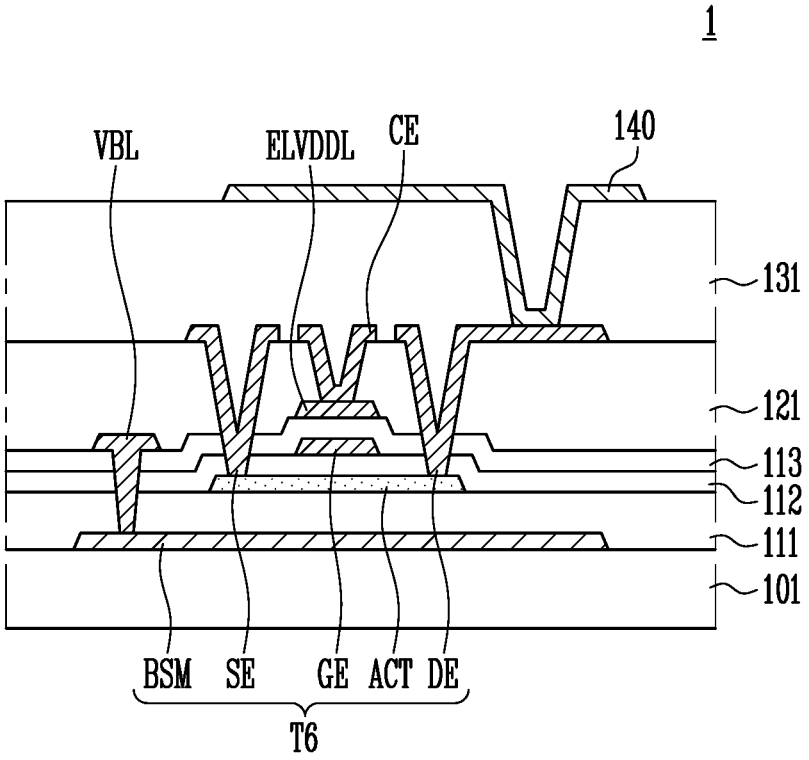
FIG. 5 is a cross-sectional view of some areas in a display device according to some embodiments of the present disclosure.

FIG. 5 is a cross-sectional view of some areas in a display device according to some embodiments of the present disclosure. FIG. 5 corresponds to a stacked structure of a region in which a double gate transistor (e.g., the sixth transistor T6) is located. Hereinafter, the stacked structure of the sixth transistor T6 that is a double gate transistor will be described, but may be applied to other double gate transistors.

A substrate 101 may be a rigid substrate or a flexible substrate. Here, when the substrate 101 is the rigid substrate, the substrate 101 may be one of a glass substrate, a quartz substrate, a glass ceramic substrate, and/or a crystalline glass substrate. When the substrate 101 is the flexible substrate, the substrate 101 may be one of a film substrate including a polymer organic material and/or a plastic substrate. In addition, the substrate 101 may include fiber glass reinforced plastic (FRP). The substrate 101 may function as a base substrate.

In some embodiments, a buffer layer may be located on the substrate 101. The buffer layer may smoothen a surface of substrate 101, and may reduce or prevent penetration of moisture or air. The buffer layer may be an inorganic layer. The buffer layer may be a single layer or may be a multiple layer.

A first conductive layer may be located on the buffer layer. The first conductive layer may be patterned to form a bottom gate electrode BSM of the sixth transistor T6. The bottom gate electrode BSM may correspond to the second gate electrode of the sixth transistor T6. The first conductive layer may include at least one of molybdenum (Mo), aluminum (Al), copper (Cu), and/or titanium (Ti). The first conductive layer may be a single layer or a multiple layer. In some embodiments, the bottom gate electrode may have a larger size (or area) than a semiconductor layer ACT.

In some embodiments, a light-shielding layer/light-blocking layer may be located between the substrate 101 and the first conductive layer. In this case, the light-shielding layer may reduce or prevent a leakage current, and may reduce or prevent degradation of the sixth transistor T6 due to light, by blocking light incident from the outside of the substrate 101 to the semiconductor layer ACT of the sixth transistor T6, thereby improving an output stability of the sixth transistor T6. To this end, the light-shielding layer may have a larger size (or area) than the semiconductor layer ACT.

The light-shielding layer may be formed of an opaque metallic material, a semiconductor material, and/or a light-absorption material having conductivity. For example, the light-blocking layer may be formed of a semiconductor material of silicon (Si), germanium (Ge), and/or silicon-germanium (SiGe) that is a dielectric material having an electric conductivity and a light absorption coefficient. Because the semiconductor includes a semiconductor material including germanium (Ge) having a high light-shielding rate, the semiconductor blocks external light or internal light that is incident to the semiconductor layer ACT.

A first insulation layer 111 may be located on the first conductive layer. The first insulation layer 111 may be an inorganic layer and/or an organic layer. The first insulation layer 111 may be a single layer or a multiple layer.

The semiconductor layer ACT may be located on the first insulation layer 111. In some embodiments, the semiconductor layer ACT may include an LTPS semiconductor.

The semiconductor layer ACT may include a channel region, and may also include a source and a drain region that are located on respective sides of the channel region and that are doped with an impurity. The source region may be connected to the source electrode SE of the sixth transistor T6, and the drain region may be connected to the drain electrode DE of the sixth transistor T6.

The second insulation layer 112 may be located on the semiconductor layer ACT. The second insulation layer 112 may function to protect the semiconductor layer ACT of the sixth transistor T6 from the outside. The second insulation layer 112 may be an inorganic layer and/or an organic layer. The second insulation layer 112 may be a single layer or a multiple layer.

A second conductive layer may be located on the second insulation layer 112. The second conductive layer may be patterned to form a top gate electrode GE of the sixth transistor T6. The top gate electrode GE may correspond to the first gate electrode of the sixth transistor T6. The second conductive layer may include at least one of molybdenum (Mo), aluminum (Al), copper (Cu), and/or titanium (Ti). The second conductive layer may be a single layer or a multiple layer.

The third insulation layer 113 may be located on the second conductive layer. The third insulation layer 113 may be an inorganic layer and/or an organic layer. The third insulation layer 113 may be a single layer or a multiple layer.

A third conductive layer may be located on the third insulation layer 113. The third conductive layer may be patterned to form a power line or the like. For example, the second conductive layer may include the high power line ELVDDL and the gate voltage control line VBL. The gate voltage control line VBL may be connected to the bottom gate electrode BSM of the sixth transistor T6 through a contact hole passing through the first insulation layer 111, the second insulation layer 112, and the third insulation layer 113.

The first protective layer 121 may be located on the third conductive layer. The first protective layer 121 may be located to cover a pixel circuit including the transistors T1 to T7. The first protective layer 121 may be a passivation layer or a planarization layer. The passivation layer may include SiO2, SiNx, and the like, and the planarization layer may include a material such as acryl or polyimide. The first protective layer 121 may include both a passivation layer and a planarization layer.

A fourth conductive layer may be located on the first protective layer 121. The fourth conductive layer may include the source electrode SE, the drain electrode DE, and the connecting electrode CE. The fourth conductive layer may be formed of a metallic material having conductivity. For example, the fourth conductive layer may include aluminum (Al), copper (Cu), titanium (Ti), and/or molybdenum (Mo).

The source electrode SE and the drain electrode DE may be respectively connected to the source region and the drain region of the semiconductor layer ACT through a respective contact hole passing through the second insulation layer 112, the third insulation layer 113, and the first protective layer 121.

The bottom gate electrode BSM, the semiconductor layer ACT, the top gate electrode GE, the source electrode SE, and the drain electrode DE described above may constitute the sixth transistor T6, which is a double gate transistor.

The connecting electrode CE may be connected to the high power line ELVDDL through a contact hole passing through the first protective layer 121. In some embodiments, the connecting electrode CE may be electrically connected to the light-emitting line ELn (see FIG. 4).

The second protective layer 131 may be located on the fourth conductive layer. The second protective layer 131 may cover the pixel circuit like the first protective layer 121. The second protective layer 131 may be a passivation layer or a planarization layer. The passivation layer may include SiO2, SiNx, and the like, and the planarization layer may include a material such as acryl or polyimide. The second protective layer 131 may include both a passivation layer and a planarization layer. In this case, the passivation layer may be located on the fourth conductive layer, and the planarization layer may be located on the passivation layer.

One or more first electrode layers 140 are located on the second protective layer 131. The first electrode layer 140 may include a pixel electrode located for each pixel. The pixel electrode may be an anode of the corresponding light emitting diode. The first electrode layer 140 may be electrically connected to the drain electrode DE (or source electrode SE) of the sixth transistor T6 through a via hole passing through the second protective layer 131.

The first electrode layer 140 may include a material having a relatively high work function. The first electrode layer 140 may include indium tin oxide (ITO), indium zinc oxide (IZO), zinc oxide (ZnO), indium oxide (In2O3), and the like. The illustrated conductive materials have a relatively large work function but also have a transparent characteristic. When the display device 1 is a top emission type, a reflective material such as silver (Ag), magnesium (Mg), aluminum (Al), platinum (Pt), lead (Pd), gold (Au), nickel (Ni), neodymium Nd, iridium (Ir), chromium (Cr), lithium (Li), calcium (Ca) or a mixture thereof may be further included in addition to the illustrated conductive material. Accordingly, the first electrode layer 140 may have a single layer structure formed of any one of the illustrated conductive material while also having a reflective material, or may have a multiple layer structure in which the illustrated conductive material and a reflective material are stacked.

Because the disposition structure on the first electrode layer 140 may be applied as a known disposition structure on the anode of a known organic light emitting diode display, a description thereof will be omitted. For example, a light-emitting element layer, a second electrode layer including the cathode, an encapsulation layer, a touch sensing layer, and a window substrate may be sequentially located on the first electrode.

Figure 6:
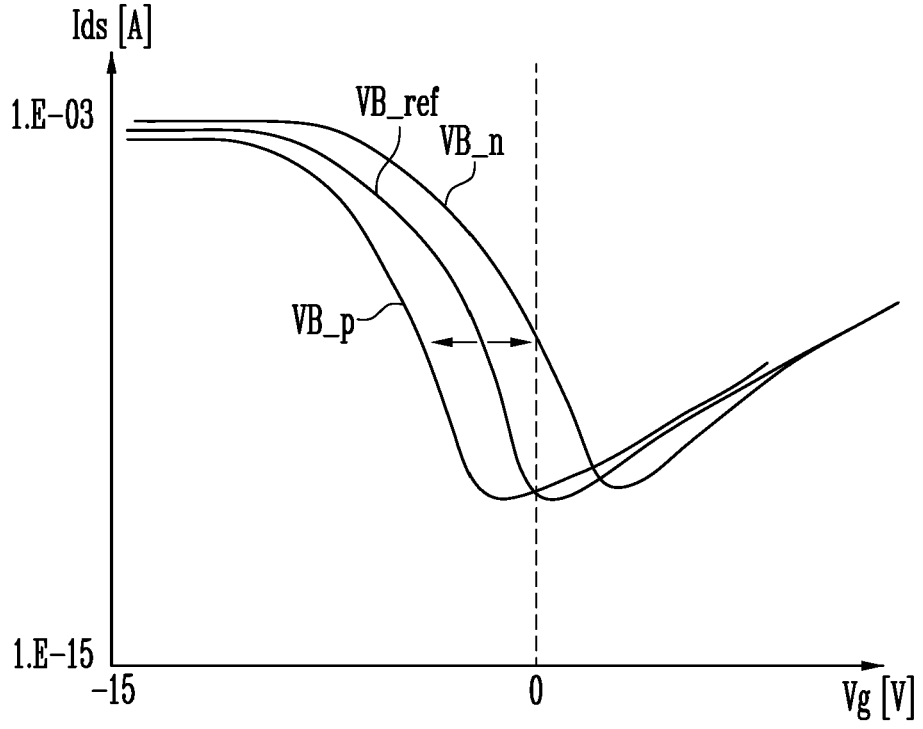
FIG. 6 is an I-V curve graph showing a characteristic (i.e., current-driving characteristic) when a bias voltage signal is applied to a second gate electrode in a sixth transistor shown in FIG. 3.

FIG. 6 is an I-V curve graph showing a characteristic (i.e., a current-driving characteristic) when a bias voltage signal is applied to a second gate electrode in a sixth transistor shown in FIG. 3. The I-V curve graph shows a current level of the driving current Ids flowing between the source and drain electrodes of the sixth transistor T6 with respect to a voltage level of the first gate electrode Vg.

In FIG. 6, a VB_ref graph shows a current-driving characteristic when a reference voltage signal is applied. A VB_p graph shows a current-driving characteristic when a bias voltage signal that is larger than the reference voltage signal in a negative direction is applied. A VB_n graph shows a current-driving characteristic when a bias voltage signal that is larger than the reference voltage signal in a positive direction is applied. Here, the reference voltage signal is a target value of a driving current when a data voltage is applied, and becomes a reference to apply a bias voltage signal.

When a bias voltage signal is applied to the second gate electrode, a threshold voltage of the sixth transistor T6 may change. For example, the threshold voltage may be shifted according to the bias voltage signal applied to the second gate electrode. For example, when the bias voltage signal applied to the second gate electrode is about 1V, the threshold voltage of the sixth transistor T6 is shifted by about −1V (e.g., see VB_p vs. VB_ref in FIG. 6). When the bias voltage signal applied to the second gate electrode is about −1V, the threshold voltage of the sixth transistor T6 is shifted by about 1V (e.g., see VB_n vs. VB_ref in FIG. 6). Some embodiments of the present disclosure may control a current level of the driving current Ids flowing to the light emitting diode LD by controlling the threshold voltage of the sixth transistor T6 provided in each pixel using the characteristics of the sixth transistor T6 described above.

Figure 7:
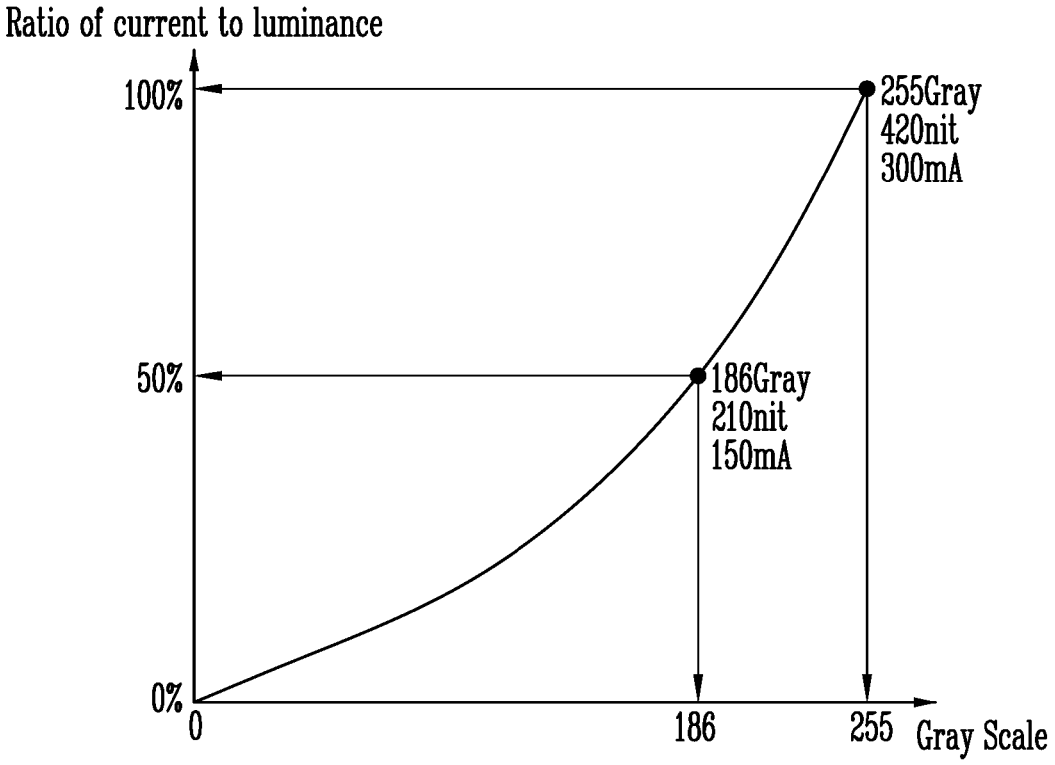
FIG. 7 is a 2.2 gamma curve graph showing a luminance and a current ratio according to a gray scale value.

FIG. 7 is a 2.2 gamma curve graph showing a ratio of current-to-luminance according to a gray scale value. A graph in FIG. 7 refers to a panel with a consumption current of about 300 mA at a gray scale value of 255 (a gray scale of full white).

In general, the display device 1 increases a ratio of current-to-luminance as the gray scale increases. However, the increase of the gray scale may not be linear. For example, at 186 grayscale, the luminance may be about 210 nit and the consumption current may be about 50 mA. At 255 gray scale, the luminance may be about 420 nit and the consumption current may be about 300 mA.

When the gray scale of the display device 1 differs by about 2 or 3 or more, a possibility of a visible luminance change may increase. In some embodiments, the display device 1 may maintain the current value deviation of the driving current Ids flowing in the light emitting diode LD below the reference value, thereby reducing the possibility of the luminance change being noticed by the user.

For example, in a case where a target gray scale is about 186, the luminance change may be visible to the user when the gray scale is about 188 or more or about 184 or less, as such gray scale values are different from the target gray scale by about 2 or more, as shown in Table 1 below. For example, when the display device 1 driven at a variable frequency is driven at a low frequency of about 1 Hz to about 30 Hz, the luminance change may be easily perceived by the user. Here, the target gray scale may be referred to as a gray scale that is measured by a naked eye when a data voltage corresponding to a gray scale to be a target is applied to a pixel PXnm.

TABLE 1

| Gray scale | Luminance[nit] | Current[mA] | Current difference with respect to 186 gray scale |
|---|---|---|---|
| . . . | . . . | . . . | . . . |
| 183 | 202.42 | 144.59 | −5.27 (−3.51%) |
| 184 | 204.86 | 146.33 | −3.25 (−2.35%) |
| 185 | 207.32 | 148.08 | −1.77 (−1.18%) |
| 186(Target) | 209.79 | 149.85 | |
| 187 | 212.28 | 151.63 | 1.78 (1.19%) |
| 188 | 214.79 | 153.42 | 3.57 (2.38%) |
| 189 | 217.31 | 155.22 | 5.37 (3.58%) |
| . . . | . . . | . . . | . . . |

That is, when a difference between the target current value of the target gray scale and the driving current Ids is at a given ratio or percentage (e.g., at a predetermined ratio or percentage corresponding to a target value) or more, the luminance change may be noticed by the user. For example, the difference between the target current value and the driving current Ids may be set to the ratio of about 2% or more. In other words, when the luminance is changed to have a difference of about 2% or more (e.g., 2% of the target luminance), the luminance change may be experienced by the user. A current value of the driving current Ids flowing in the light emitting diode LD may be controlled using a double gate transistor connected between the high power line ELVDDL and the low power line ELVSSL. For example, the current level of the driving current Ids flowing in the light emitting diode LD may be controlled by using the sixth transistor T6, which is a double gate transistor. The current level of the driving current Ids may be controlled by applying a bias voltage signal to the second gate electrode described above. To increase the current level of the reduced driving current Ids, the bias voltage signal may apply a bias voltage signal having a negative voltage level.

Figure 8:
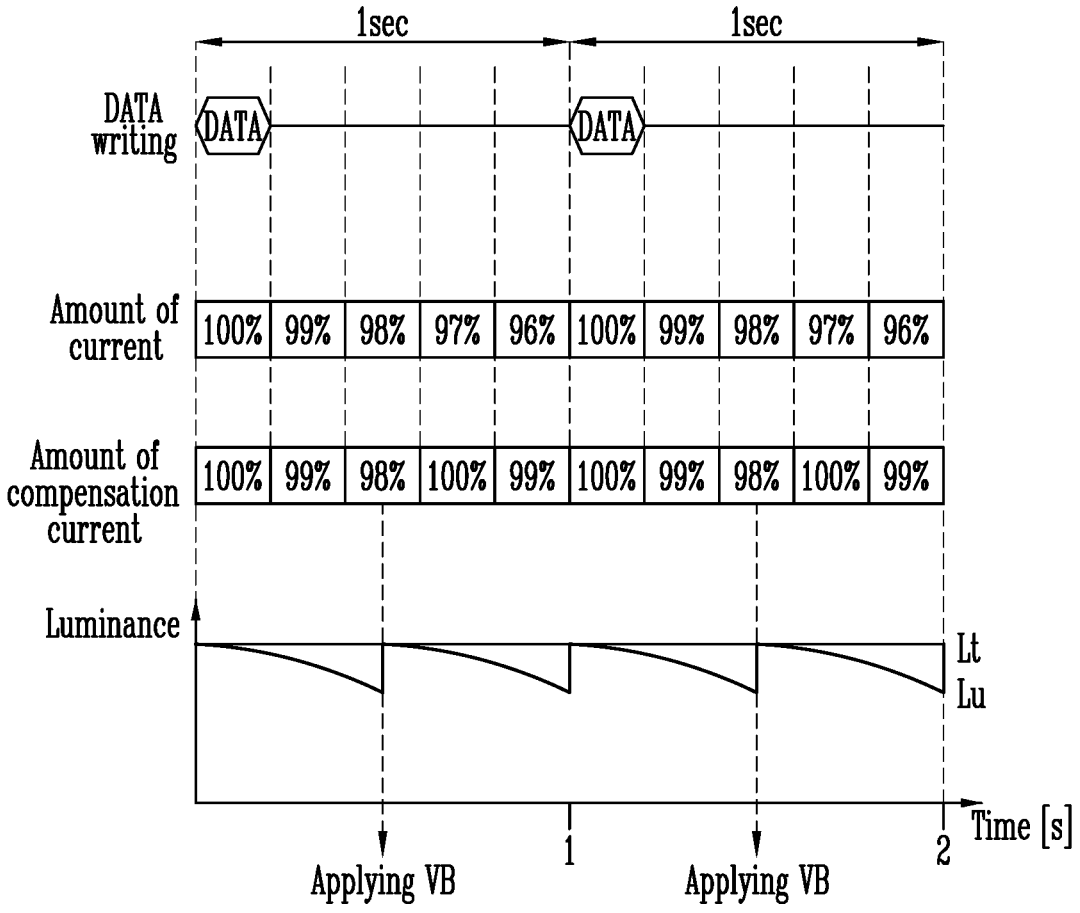
FIG. 8 is a drawing showing a current and voltage signal applied for 2 seconds in a pixel in a display device according to some embodiments of the present disclosure.

FIG. 8 is a drawing showing a current and voltage signal applied for 2 seconds in a pixel in a display device according to some embodiments of the present disclosure. FIG. 8 assumes that a data voltage DATA is applied to one pixel PXnm once per second.

Referring to FIG. 8, when the data voltage DATA is applied, a current amount of the driving current Ids maintains the target current level of 100%, and the current level of the driving current Ids may thereafter decrease over time until the next data voltage DATA is applied again. For example, the current level of the driving current Ids may gradually decrease to 99%, 98%, 97%, and 96% until the next data voltage DATA is applied again. Accordingly, the gray scale may be lowered and the luminance Lu may be reduced. Here, the target luminance is represented as Lt when the target current level is 100%. The current level of the driving current Ids may be measured by the current sensor 70 described above.

A current applied to the sixth transistor T6 may have a current level that is similar to the driving current Ids flowing in the light emitting diode LD. When the data voltage DATA is applied, the current applied to the sixth transistor T6 may maintain the current level of 100%, and then may gradually decrease.

When the driving current Ids is changed by the reference value or more, the gate voltage controller 80 may apply the bias voltage signal VB to the second gate electrode of the sixth transistor T6 to compensate for the driving current Ids. The bias voltage signal VB may be applied to the second gate electrode of the sixth transistor T6 to compensate the current for generating a compensated current level that is 100% of the target current value.

When the current GI sensed by the current sensor 70 becomes the reference level according to a ratio set with respect to the target level, the gate voltage controller 80 may apply the bias voltage signal VB to the second gate electrode of the sixth transistor T6 to compensate for the current so that the luminance change of the display device 1 may be imperceptible to the user as described above. Accordingly, it is possible to reduce or minimize the possibility of the user viewing the luminance change when the display device 1 is driven at a low frequency.

Next, a display device according to some embodiments will be described. Hereinafter, the same reference numerals are given for similar or the same constituent elements as the embodiments of FIGS. 1 to 8, and a detailed description thereof will be omitted.

Figure 9:
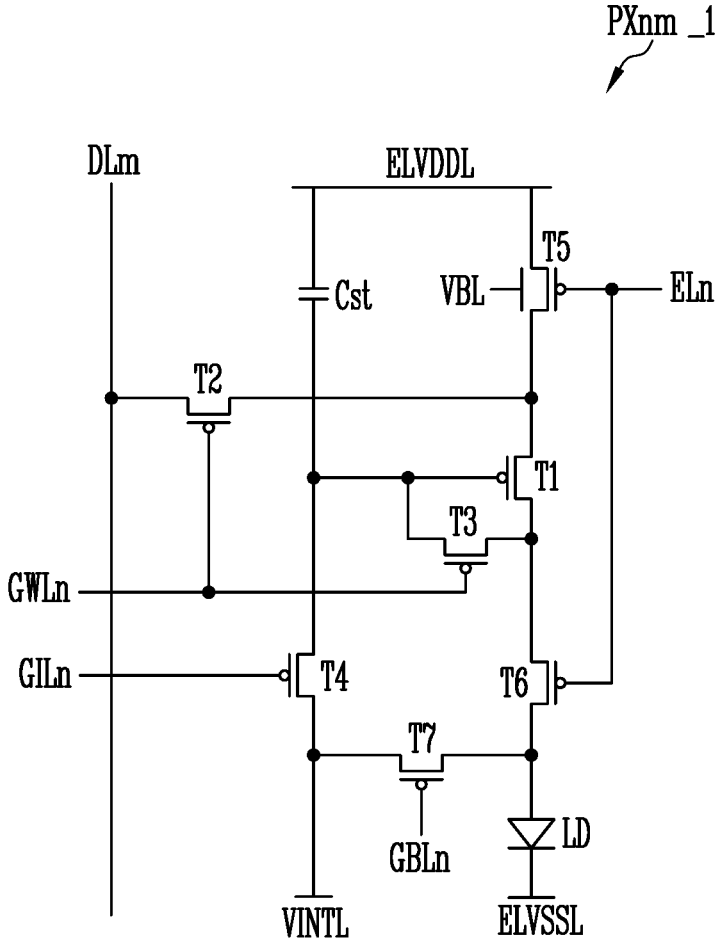
FIGS. 9 and 10 are equivalent circuits of one pixel in a display device according to some embodiments of the present disclosure.
Figure 10:
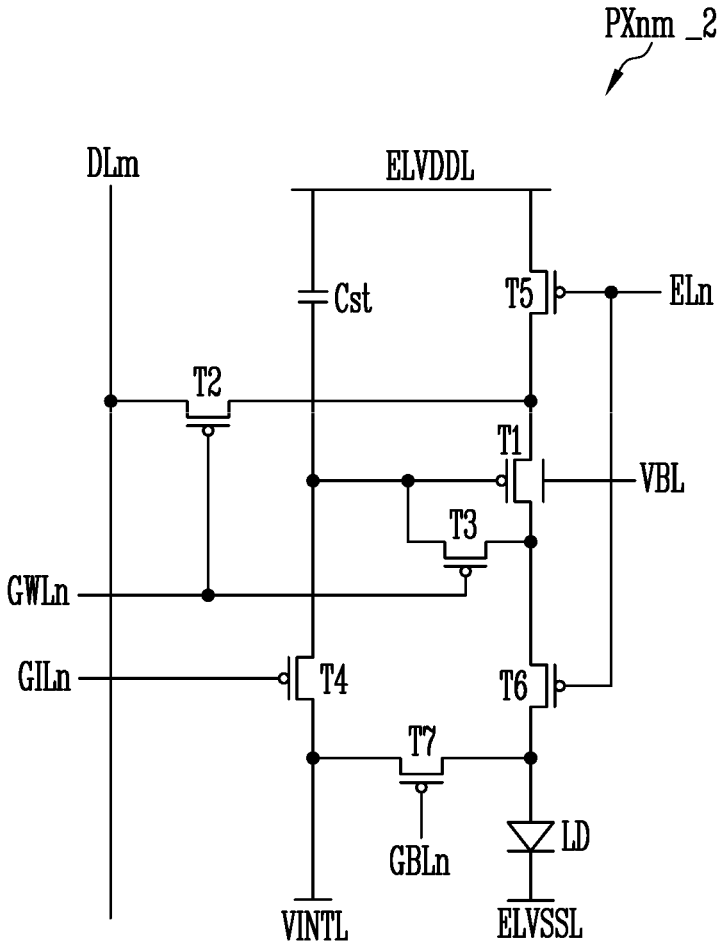

FIGS. 9 and 10 are equivalent circuits of one pixel in a display device according to some embodiments of the present disclosure.

Referring to FIGS. 9 and 10, pixels PXnm_1 and PXnm_2 in the display device according to embodiments of the present disclosure are different from the pixel PXnm shown in FIG. 4 in that a respective first transistor T1 or fifth transistor T5 is a double gate transistor.

Similarly, the driving current Ids may be compensated by using a double gate transistor located between a high power line ELVDDL and a low power line ELVSSL. Therefore, the first transistor T1 or fifth transistor T5 is formed of the double gate transistor, thereby compensating for the current level of the driving current Ids.

However, embodiments are not limited thereto. A plurality of transistors (e.g. T1, T5, and T6) located between the high power line ELVDDL and the low power line ELVSSL are formed of the double gate transistor, thereby compensating for the driving current Ids.

Figure 11:
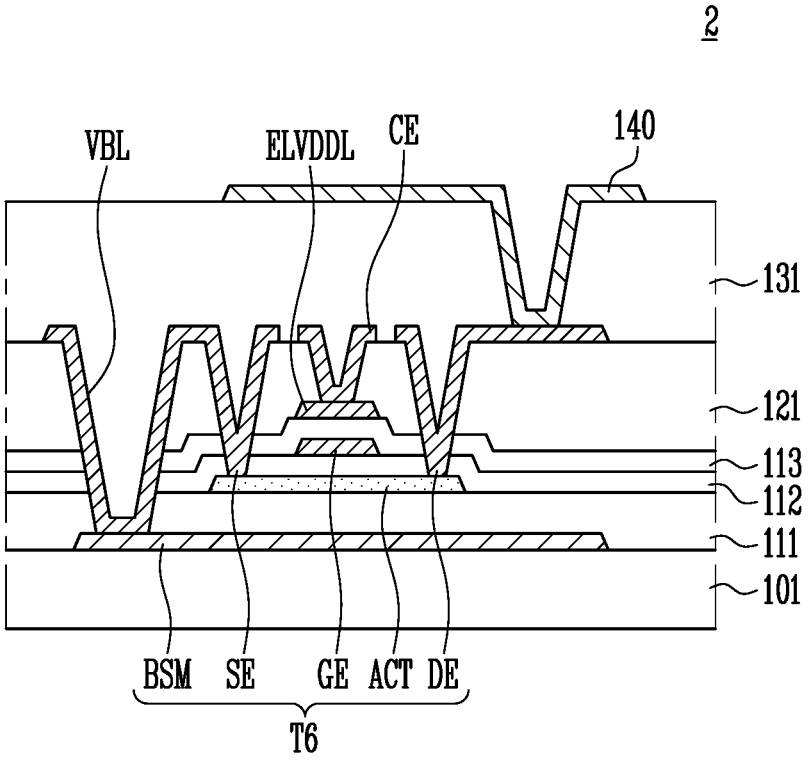
FIG. 11 is a cross-sectional view of some areas in a display device according to some embodiments of the present disclosure.

FIG. 11 is a cross-sectional view of some areas in a display device according to some embodiments of the present disclosure.

Referring to FIG. 11, one pixel in the display device 2 of the present example is different from that in the display device 1 shown in FIG. 4 in that the gate voltage control line VBL is integrally formed with the source electrode SE.

The gate voltage control line VBL may be patterned with the fourth conductive layer. The gate voltage control line VBL of the sixth transistor T6 may be connected to the bottom gate electrode BSM through a contact hole passing through the first insulation layer 111, the second insulation layer 112, the third insulation layer 113, and the first protective layer 121.

The gate voltage control line VBL may extend to form the source electrode SE of the sixth transistor T6. At this time, the same electrical signal may be applied to the gate voltage control line VBL and the source electrode SE.

Figure 12:
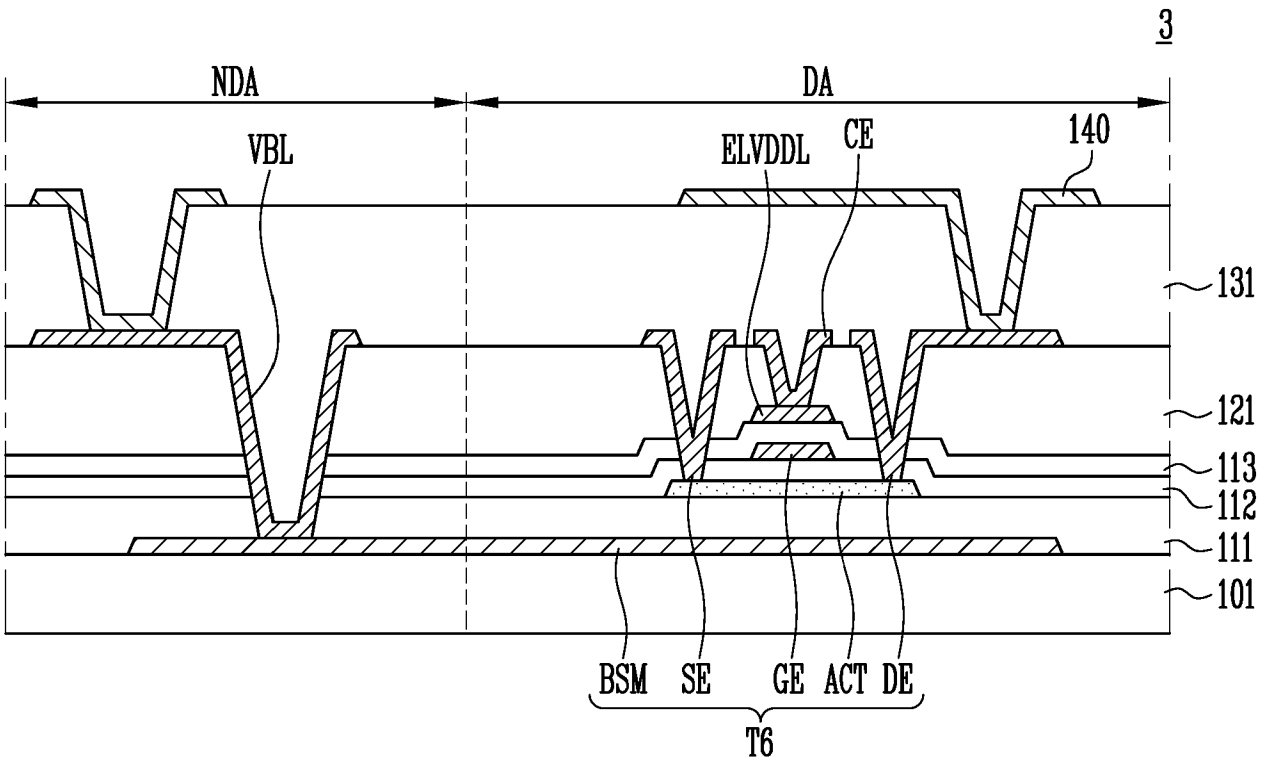
FIG. 12 is a cross-sectional view of some areas in a display device according to some embodiments of the present disclosure.

FIG. 12 is a cross-sectional view of some areas in a display device according to some embodiments of the present disclosure.

Referring to FIG. 12, one pixel in the display device 3 of the present example is different from that in the display device 1 shown in FIG. 4 in that the bottom gate electrode BSM is formed over the display area DA and the non-display area NDA, and in that the gate voltage control line VBL and the bottom gate electrode BSM are connected to each other in the non-display area NDA.

The sixth transistor T6 in some pixels of the display device 3 may include the bottom gate electrode BSM formed over the display area DA and the non-display area NDA. The bottom gate electrode BSM of the sixth transistor T6 in the pixel may be connected to the gate voltage control line VBL in the non-display area NDA.

FIGS. 13 to 16 are timing diagrams showing an application of a bias voltage to a change in a driving current flowing in a light emitting diode of a display device according to some embodiments of the present disclosure. The bias voltage signal VB may be applied to the second gate electrode of the sixth transistor T6 when the current level of the driving current Ids, or the luminance, changes by more than a given ratio or percentage (e.g., a predetermined ratio, or a predetermined percentage of a target value or a target luminance) (%). Hereinafter, it is assumed that the current level of the driving current Ids, or the luminance, changes by more than about 2%, which may be an example of a predetermined ratio (%), four times within one second.

Figure 13:
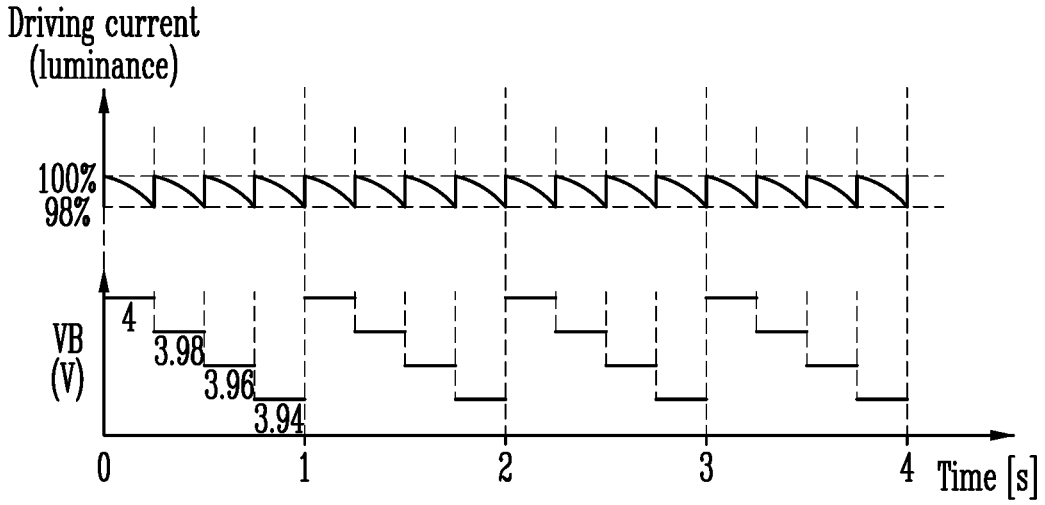
FIGS. 13 to 16 are timing diagrams showing an application of a bias voltage to a change in a driving current flowing in a light emitting diode of a display device according to some embodiments of the present disclosure.

Referring to FIG. 13, the present example shows that driving current Ids (or luminance) flowing in the light emitting diode LD decreases after applying the data voltage DATA.

In some embodiments, the bias voltage signal VB applied to the second gate electrode of the sixth transistor T6 is continuously applied to compensate for the driving current Ids, but the voltage level of the bias voltage signal VB may decrease stepwise. For example, when the current level (or luminance) of the target driving current Ids is lowered by about 2% or more from the level of 100% after the data voltage DATA is applied, the bias voltage signal VB may be initially applied. At this time, the bias voltage signal VB may be, for example, about 4V. The level of the driving current Ids may be restored to the target current level of 100% by the first current compensation.

Hereinafter, the level of the driving current Ids may decrease by about 2% or more, and the bias voltage signal VB may be secondarily applied. At this time, the bias voltage signal VB may be, for example, about 3.98V. The level of the driving current Ids may be restored to the target current level of about 100% by the second current compensation/the secondarily applied bias voltage signal VB.

In this manner, when the level of the driving current Ids decreases by about 2% or more, the bias voltage signal VB may be applied a third time, and then the bias voltage signal VB may be applied a fourth time. At this time, the bias voltage signal VB may be, for example, about 3.96V at the third time and about 3.94V at the fourth time.

Figure 14:
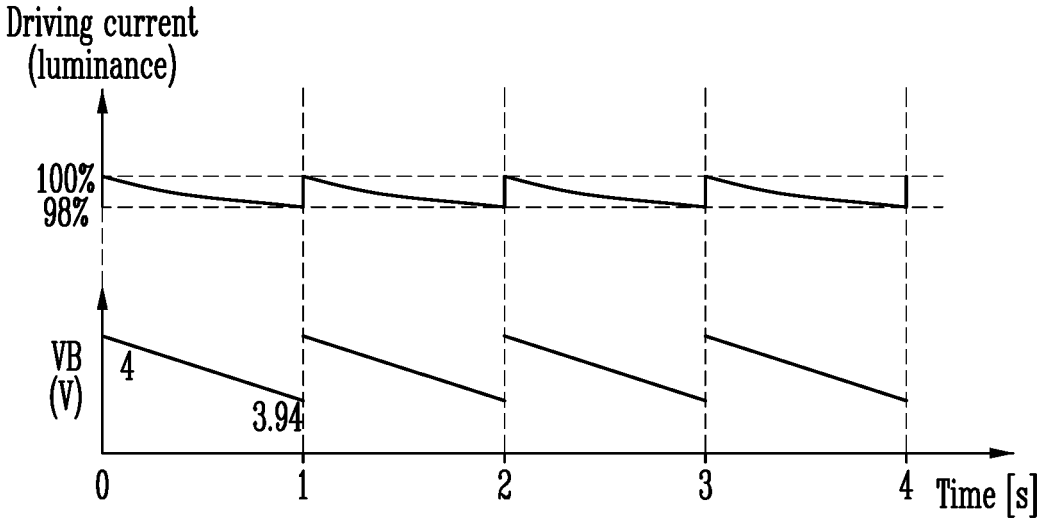

Referring to FIG. 14, the present example shows that driving current Ids (or luminance) flowing in the light emitting diode LD decreases after applying the data voltage DATA.

In some embodiments, the bias voltage signal VB applied to the second gate electrode of the sixth transistor T6 is continuously applied to compensate for the driving current Ids, but the voltage level of the bias voltage signal VB may decrease linearly. For example, a bias voltage signal VB that decreases linearly from about 4V to about 3.94V over the course of one second may be applied.

Figure 15:
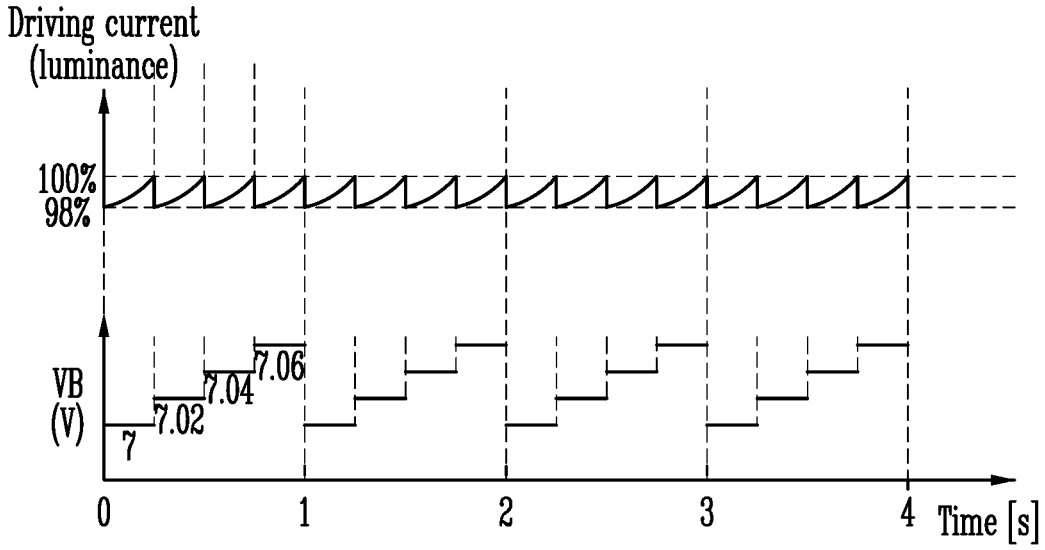

Referring to FIG. 15, the present example shows that driving current Ids (or luminance) flowing in the light emitting diode LD increases after applying the data voltage DATA. In some embodiments, the bias voltage signal VB applied to the second gate electrode of the sixth transistor T6 is continuously applied to compensate for the driving current Ids, but the voltage level of the bias voltage signal VB may increase stepwise.

Figure 16:
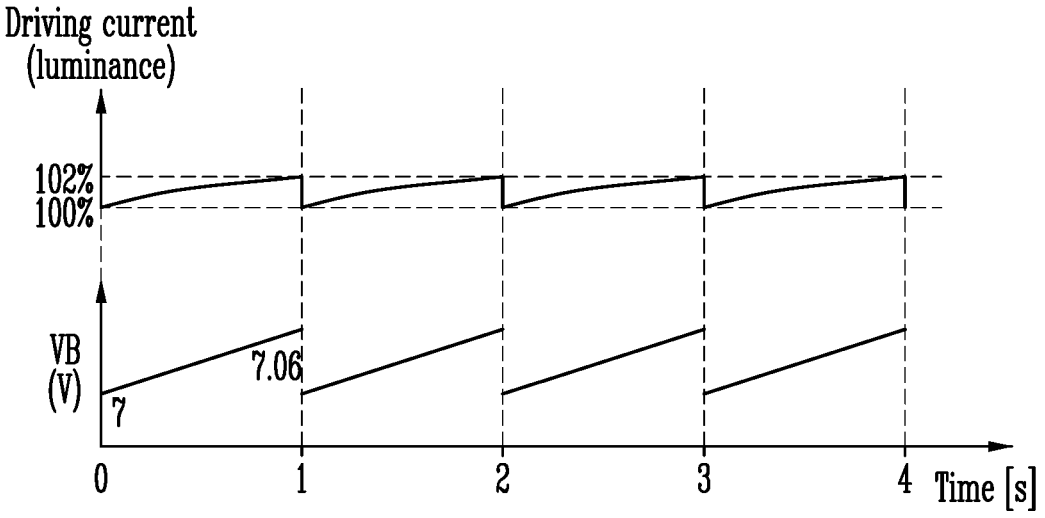

Referring to FIG. 16, the present example shows that driving current Ids (or luminance) flowing in the light emitting diode LD increases after applying the data voltage DATA. In some embodiments, the bias voltage signal VB applied to the second gate electrode of the sixth transistor T6 is continuously applied to compensate for the driving current Ids, but the voltage level of the bias voltage signal VB may increase linearly.

As described above, the bias voltage signal VB may be provided to the second gate electrode of the sixth transistor in various ways.

While embodiments of the present disclosure are described with reference to the attached drawings, those with ordinary skill in the technical field of the present disclosure pertains will be understood that the present disclosure can be carried out in other specific forms without changing the technical idea or essential features. The embodiments should be considered in descriptive sense only and not for purposes of limitation. Therefore, the disclosed subject matter should not be limited to any single embodiment described herein, and the scope of the present inventive concept shall be determined according to the attached claims, with functional equivalents thereof to be included therein.

What is claimed is:

1. A display device comprising:

a display comprising a pixel comprising a double gate transistor and a light emitting diode;

a power supply for supplying power to the display;

a current sensor for sensing a current flowing in the display or in the light emitting diode; and a gate voltage controller for providing a bias voltage signal to one gate electrode of the double gate transistor when the current sensor senses a current that changes by more than a ratio with respect to a target value, wherein the target value is the current flowing in the display or in the light emitting diode sensed by the current sensor when a data voltage is applied to the pixel every frame.

2. The display device of claim 1, wherein the double gate transistor comprises:

a bottom gate electrode;

a semiconductor layer on the bottom gate electrode;

a top gate electrode on the semiconductor layer; and a source electrode and a drain electrode on the top gate electrode.

3. The display device of claim 2, wherein the bottom gate electrode is connected to a gate control line for receiving the bias voltage signal from the gate voltage controller.

4. The display device of claim 3, wherein the bottom gate electrode has a greater area than the semiconductor layer.

5. The display device of claim 2, wherein the source electrode or the drain electrode of the double gate transistor is connected to an anode of the light emitting diode.

6. The display device of claim 1, wherein the gate voltage controller is configured to provide the bias voltage signal at least once in one second.

7. The display device of claim 6, wherein the gate voltage controller is configured to increase or decrease the bias voltage signal stepwise or linearly in the one second.

8. The display device of claim 1, wherein the double gate transistor is connected between a high power line and a low power line.

9. The display device of claim 8, wherein a source electrode or a drain electrode of the double gate transistor is connected to an anode of the light emitting diode.

10. The display device of claim 1, wherein the double gate transistor comprises a P-type transistor.

11. The display device of claim 10, wherein the P-type transistor comprises a low temperature polysilicon (LTPS) semiconductor.

12. The display device of claim 1, wherein the ratio is 2%.

13. The display device of claim 1, wherein the display device is configured to be driven at a frequency of about 1 Hz to about 30 Hz.

14. The display device of claim 1, wherein the gate voltage controller is configured to provide the bias voltage signal having a positive voltage level when a current changes in a positive direction with respect to the target value, and wherein the gate voltage controller is configured to provide the bias voltage signal having a negative voltage level when a current changes in a negative direction relative to the target value.

15. The display device of claim 1, wherein the gate voltage controller comprises a power management integrated circuit (PMIC).

16. A driving method of a display device comprising a pixel comprising at least one double gate transistor and a light emitting diode that is electrically connected to a source or drain electrode of the double gate transistor, the method comprising:

applying a data voltage to the pixel;

sensing a current flowing in the light emitting diode; and applying a bias voltage signal to one gate electrode of the double gate transistor when a current flowing in the light emitting diode changes by more than a given ratio with respect to a target value, wherein the target value is the current flowing in the light emitting diode sensed by a current sensor when the data voltage is applied to the pixel every frame.

* * * * *